US007151491B2

(12) United States Patent
Jacquinot

(10) Patent No.: US 7,151,491 B2
(45) Date of Patent: Dec. 19, 2006

(54) MULTIBAND PLANAR ANTENNA

(75) Inventor: Daniel Jacquinot, Caurel (FR)

(73) Assignee: Antennes FT Societe a Responsabilite Limitee, Reims (FR)

( * ) Notice: Subject to any disclaimer, the term of this patent is extended or adjusted under 35 U.S.C. 154(b) by 0 days.

(21) Appl. No.: 10/516,375

(22) PCT Filed: Jun. 17, 2003

(86) PCT No.: PCT/FR03/01829

§ 371 (c)(1),
(2), (4) Date: Jul. 11, 2005

(87) PCT Pub. No.: WO2004/004066

PCT Pub. Date: Jan. 8, 2004

(65) Prior Publication Data

US 2006/0164303 A1 Jul. 27, 2006

(30) Foreign Application Priority Data

Jun. 28, 2002 (FR) ..... 02 08113

(51) Int. Cl.
*H01Q 1/38* (2006.01)

(52) U.S. Cl. ..... 343/700 MS; 343/770; 343/833

(58) Field of Classification Search ..... 343/700 MS, 343/829, 846, 767, 770, 833
See application file for complete search history.

(56) References Cited

U.S. PATENT DOCUMENTS 4,692,769 A * 9/1987 Gegan ..... 343/700 MS

* cited by examiner

*Primary Examiner*—Michael C. Wimer
(74) *Attorney, Agent, or Firm*—Egbert Law Offices

(57) ABSTRACT

The invention concerns a planar broadband patch antenna, in particular for transmitting and/or receiving digital and/or analogue terrestrial television UHF/SHF signals, having a bandwidth low frequency tuned reflector and a radiator connected to a specific power supply and radiating in a frequency F1. The radiator also has a slot tuned to a frequency F2. The antenna is characterized in that the radiator has another slot tuned to a frequency F3 different from frequencies F1 and F2, the slots being connected through a linking slot designed to constitute a coupling line to provide a substantially identical electromagnetic current at each of the slots of frequency F2, F3, respectively.

6 Claims, 1 Drawing Sheet

MULTIBAND PLANAR ANTENNA

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a planar broadband patch antenna, in particular for transmitting and/or receiving digital and/or analogue terrestrial television UHF/SHF signals, comprising a bandwidth low frequency tuned reflector and a radiator connected to a specific power supply and radiating at a frequency F1, said radiator further having a slot tuned to a frequency F2.

BACKGROUND OF THE INVENTION

There are already known a number of planar patch antennas the bandwidth of which one has been trying to widen for a long time, in order to allow receiving waves in a broad frequency band by means of one and the same antenna.

In this respect, it should be noted that the terrestrial television signals, whether they are digital and/or analogue, have a frequency varying between about 470 and 870 MHz. As a matter of fact, unless extremely complex technical means were implemented, prior to the invention, this frequency band could not be covered by means of one and the same planar patch antenna.

In particular, as regards the planar patch antenna, there is known one that is comprised of a simple planar reflector made out of conductive material above which extends, separated by a dielectric substrate, a radiator in the form of a conductive plate the dimensions of which are determined so as to allow it, under the action of a specific current supply, to radiate at a determined frequency.

If the reflector has increased dimensions compared to the radiator, it is intended to widen the bandwidth of the antenna downwards. More exactly, this reflector is tuned, through its strip line coupling to the radiator, to a low frequency, i.e. lower than the radiation frequency of the radiator.

In order to widen the bandwidth upwards, there has been devised to superimpose to the radiator non-fed parasitic planar conductive elements. Through their stripline coupling to the radiator, these parasitic elements are caused to radiate in the upper portion of the bandwidth.

In a more recent design, there has been carried out a patch antenna the radiator plate of which, fed by a specific feeder, is tuned to a first frequency, taking into consideration that in this plate is cut out a U-shaped slot of constant width which resonates at a different frequency.

Obviously, when coupled at the radiation frequency of the radiator, this antenna with a slot results into widening the bandwidth.

The U-shaped configuration of the slot and its symmetrical arrangement with respect to the median plane transversal to the radiator, as well as the current supply occurring in this transverse plane, have been considered essential parameters to allow the electromagnetic current-supply to this slot.

In brief, a simple rectilinear slot provided in this radiator cannot be subjected to an electromagnetic current under the action of a feeder simply connected to the radiator.

Obviously, such a U-shaped slot of constant width can only radiate on its basic resonance.

To conclude, the solutions adopted hitherto have allowed a widening of the bandwidth of a patch antenna in the range of 20 to 40%, compared to its basic radiation frequency, this, of course, for a reception with a sufficient gain to allow using the received signal.

From US-2002/003499 is also known an antenna with a conductive layer and a two-band transmission device including this antenna. The latter includes a dielectric substrate including, on its lower and a higher faces, a conductive layer, the first one forming a mass, the reflector, and the second one forming a patch, the radiator, both being connected, here, by a short-circuit strip extending on a surface of a slice of the substrate.

In this case, the antenna also includes a coupling system including a primary strip line coupling formed by two slots extending parallel to each other in the wafer and forming two primary coupling slots, respectively, while a secondary strip line coupling formed by a third slot is connected to one of its two primary coupling slots.

The patch also includes a separating unit including at least a separating slot so as to create two zones forming a primary resonance zone and a secondary resonance zone, respectively. In fact, according to a particular embodiment described in this document, the separating unit can be defined by a U-shaped separating slot, remaining at a distance from the edges of the wafer and including two legs connected to each other by a base.

It should be noted, in particular, that the width of each of the separating slots forming the U is the same, while the parallel outermost slots include a similar length.

As set forth in this former document, the coupling between, on the one hand, the standing wave of each of both primary and secondary resonances and, on the other hand, the waves radiated in space, mainly occurs on one or several edges of the patch or of the separating slots or through these slots. It is specified that, in the embodiment including a U-shaped separating slot, the connecting slot forms a secondary radiating slot in addition to the other two parallel slots.

BRIEF SUMMARY OF THE INVENTION

The present invention, by changing the preconceived ideas in this matter, has been able to provide a solution for the above-mentioned problem. The improvement of the bandwidth of a patch antenna through the present invention is significant, since it allows to achieve a widening of this band in the range of 100% with respect to the low frequency.

To this end, the invention relates to a planar broadband patch antenna, in particular for transmitting and/or receiving digital and/or analogue terrestrial television UHF/SHF signals, comprising a bandwidth low frequency tuned reflector and a radiator connected to a specific power supply and radiating in a frequency F1, said radiator further having a slot tuned to a frequency F2, characterized in that the radiator also comprises at least another slot tuned to a frequency F3 different from the frequencies F1 and F2, said slots being connected through a connecting slot designed capable of forming a strip line coupling, in order to ensure an electromagnetic current at the level of each of the slots of frequency F2 and F3.

According to a first embodiment, the slots that connect the connecting slot, defining a stripline coupling, are geometrically identical, while the power supply to the radiator occurs in a unsymmetrical way between the slots, in order to ensure the radiation of the latter according to the different frequencies P2 and P3, respectively.

According to another embodiment, these slots are defined of different sizes, in order to ensure their radiation according to different frequencies F2 and F3.

Preferably also, the antenna includes, arranged above the radiator and parallel to the latter, at least a parasitic element with smaller dimensions, for a widening of the bandwidth in the upper portion of the band.

According to another feature of this invention, the reflector includes at least two of its opposite peripheral edges folded in a plane which is perpendicular to it, in the direction towards the radiator.

Advantageously, the folded opposite peripheral edges are those intersecting the plane of polarization of the radiator.

Advantageously also, these folded peripheral edges extend in a plane which, with respect to the corresponding edges of the radiator, is located at a smaller distance than that separating the plane of this radiator and that of the reflector.

It is also within the framework of an inventive step that there has been devised to lower the radiation frequency of the patch antenna by loading the radiator by nearing the latter to the opposite peripheral edges of the reflector intersecting the plane of polarization.

As already mentioned above, the advantages of this invention consist of a substantial widening of the bandwidth of a patch antenna, i.e. in the range of 100% of its low radiation frequency.

Finally, this allows such a patch antenna to cover the full range of the frequencies corresponding, for example, to the terrestrial television signals, whether they are of a digital or an analogue type.

Other objects and advantages of this invention will become clear when reading the following description relating to an embodiment which is given only by way of an indicative and non-restrictive example.

This description will be better understood when referring to the attached drawings.

DETAILED DESCRIPTION OF THE INVENTION

Figure 1:
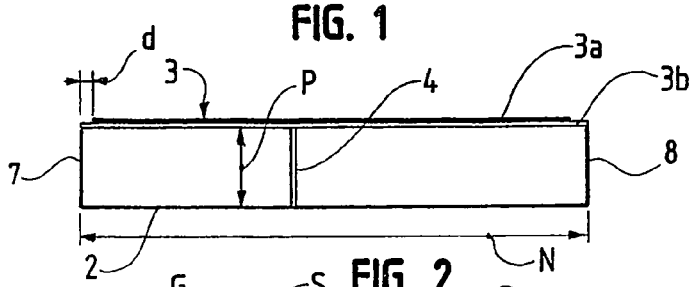
FIG. 1 is a cross-sectional view according to the electric plane of polarization (plane E) of a planar patch antenna without parasitic element according to the invention.
Figure 2:
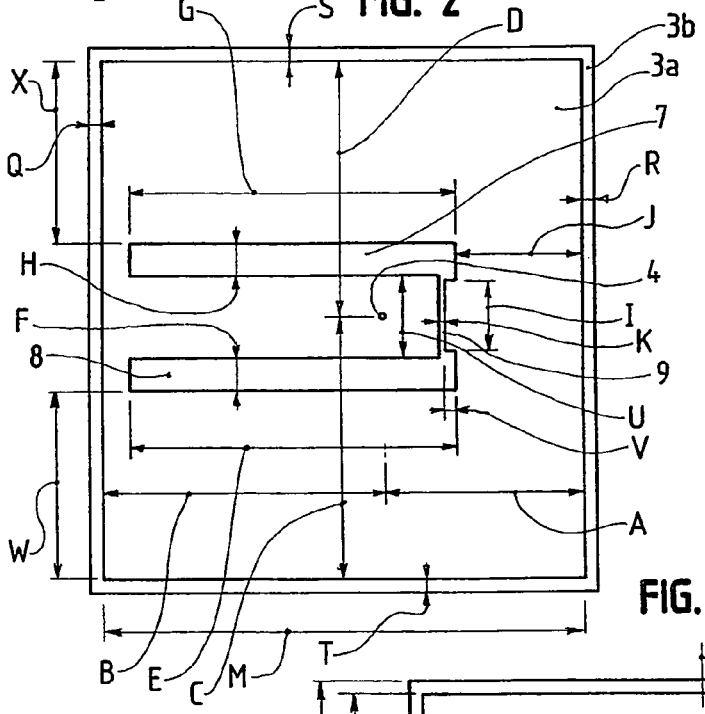
FIG. 2 is a schematic plan view of the radiator.
Figure 4:
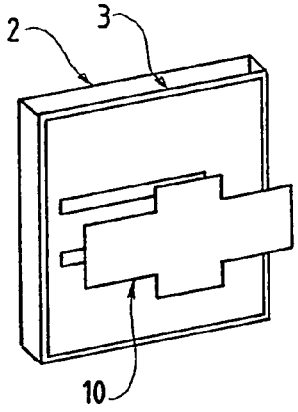
FIG. 4 is a perspective view of the antenna according to the invention.
Figure 3:
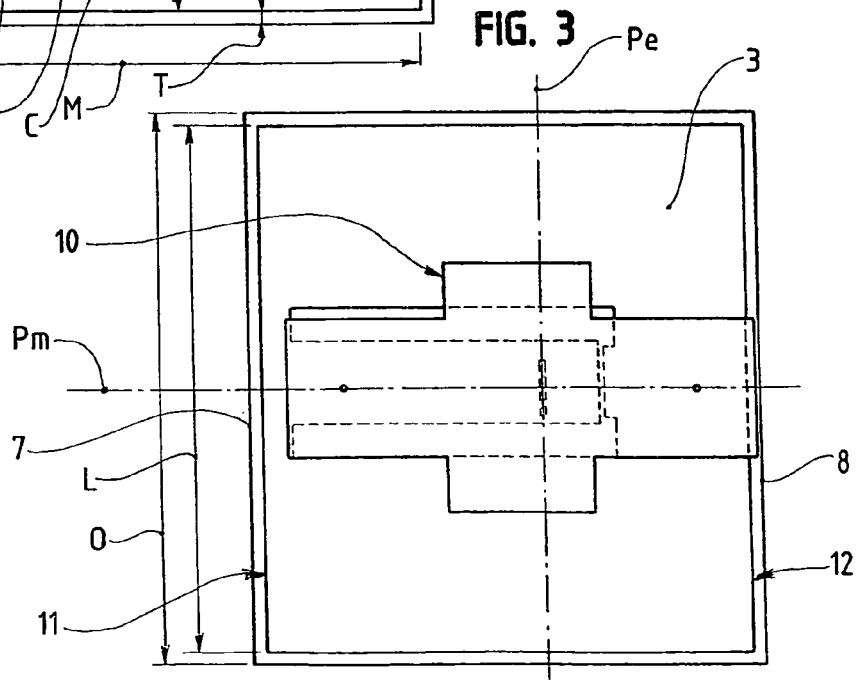
FIG. 3 is a schematic plan view of a planar antenna according to the invention the radiator of which is topped by a parasitic element.

As shown in the figures of the attached drawing, the present invention relates to planar broadband antenna for transmitting and/or receiving UHF and/or SHF signals, in particular digital and/or analogue terrestrial television signals.

This antenna 1 includes a planar reflector 2 made out of metallic material above which extends a radiator 3, also made out of metal, connected to a specific current supply 4.

A dielectric substrate separates the radiator 3 of the reflector 2, taking into consideration, in this respect, that the distance P between the latter depends on the permittivity of this substrate.

It should be noted that this distance P has an influence on the gain and the impedance of the antenna 1.

Turning back to the reflector 2, its dimensions are determined as a function of the low frequency of the frequency band in which this antenna 1 has to radiate.

In particular, by making the radiator 3 in the form of a singe-face printed circuit 3*a* on a dielectric substrate 3*b* the permittivity $\epsilon_r$ of which is higher than 1, it is possible to reduce the dimensions of the reflector 2 and, accordingly, to obtain a smaller antenna.

Starting from a given surface of the reflector 2, normally imposing the size of the antenna 1, the dimensions of the latter can be further reduced by folding, in a perpendicular plane in the direction towards the radiator 3, at least two of the opposite peripheral edges 5, 6 of this reflector 2.

According to a peculiarity of this invention, the radiator 3 includes at least two slots 7, 8 tuned to frequencies F2 and F3, respectively, different from each other and from the radiation frequency F1 of the radiator 3. In particular, these slots 7, 8 extend parallel to the plane of polarization of the radiator 3.

In this respect, the slots 7, 8 can be defined of different dimensions, in order to ensure their radiation according to different frequencies F2 and F3.

According to another embodiment, their radiation at different frequencies F2 and F3 result from an unsymmetrical current supply between said slots, whereby it should be known that the invention also extends to a solution combining either of these embodiments.

In order to ensure an electromagnetic current in each one of these slots 7, 8, these are connected through a connecting slot 9 designed capable of forming a strip line coupling.

It should be noted that, though a slot is assimilated with a capacity and a coil connected in parallel, the connecting slot 9 plays, in turn, the role of a capacity, in order to ensure this function of stripline coupling which it is aimed at.

One clearly understands that, if the reflector 2 is tuned to the low frequency of the bandwidth, the radiator 3 and the gradually smaller slots 7, 8 are tuned to higher frequencies and, therefore, form a widening of the bandwidth upwards.

In this respect, a gain in the upper portion of the band is also achieved by superposing to the radiator 3 at least one parasitic element 10 with dimensions smaller than the radiator 3 and extending substantially above the slots 7, 8.

It should be noted that the latter define, at the level of the radiator 3, an electric plane of polarization Pe and a magnetic plane of polarization Pm which is perpendicular to the latter.

Preferably, the opposite peripheral edges 5, 6 of this reflector 2, which are folded at right angles in the direction towards the radiator, are those intersected by this magnetic plane Pm.

According to another feature of this invention, the radiator 3 is loaded by nearing the folded peripheral edges 5, 6 of the reflector 2 to the corresponding edges 11, 12 of this radiator 3 by a distance d smaller than the aforementioned distance P. This results into a lowering of the low radiation frequency of the antenna 1. In brief, this solution also contributes to a reduction of the size of the antenna 1, since the dimensions of the latter are determined by those of the reflector 2, furthermore tuned to the low frequency of the bandwidth of said antenna 1.

If the example of the reception of the digital and/or analogue terrestrial television signals is now considered, extending in a frequency range between 474 and 862 MHz, the tests of an antenna according to the invention and to the dimensional characteristics given below have shown that it is capable of covering this frequency range with an optimal gain.

| | | | | |
|---|---|---|---|---|
| A = 70 mm | B = 100 mm | C = 95.5 mm | D = 95.5 mm | E = 113 mm |
| F = 12 mm | G = 113 mm | H = 12.5 mm | 1 = 36 mm | J = 46 mm |
| K = 0.9 mm | L = 191 mm | M = 170 mm | N = 176 mm | O = 198 mm |
| P = 26 mm | Q = 4 mm | R = 4 mm | S = 3.5 mm | T = 3.5 mm |
| U = 30 mm | V = 3.25 mm | W = 71 mm | X = 65.5 mm | |

Obviously, the present invention is in no way limited to these dimensions.

Finally, the present invention should be regarded as a clear progress in the technical field involved, since this frequency range of the digital and/or analogue terrestrial television signals could hitherto be covered only through using several planar patch antennas.

I claim:

1. A planar broadband patch antenna for transmitting or receiving television signals comprising:

a reflector tuned to a band;

a power supply;

a radiating means supported by said reflector and connected to said power supply, said radiating means for radiating with a first frequency, said radiating means comprising:

a first slot tuned to a second frequency; and a second slot tuned to a third frequency, said third frequency being different than said first frequency and said second frequency, said first and second slots being connected through a connecting slot, said connecting slot forming a strip line coupling so as to cause an electromagnetic current in said first slot of said second frequency and in said second slot of said third frequency; and at least one parastitic means arranged above and parallel to said radiating means, the parastitic means for widening a bandwidth in an upper portion of the band, the parastitic means having a size of smaller dimensions than a size of said radiating means.

2. The antenna of claim 1, said first slot having a size that is different than a size of said second slot.

3. The antenna of claim 1, said power supply supplying power to said radiating means unsymmetrically between said first and second slots.

4. A planar broadband patch antenna for transmitting or receiving television signals comprising:

a reflector tuned to a band;

a power supply;

a radiating means supported by said reflector and connected to said power supply, said radiating means for radiating with a first frequency, said radiating means comprising:

a first slot tuned to a second frequency; and a second slot tuned to a third frequency, said third frequency being different than said first frequency and said second frequency, said first and second slots being connected through a connecting slot, said connecting slot forming a strip line coupling so as to cause an electromagnetic current in said first slot of said second frequency and in said second slot of said third frequency, said reflector having at least two opposite peripheral edges folded in plane perpendicular to a plane at said reflector and extending toward said radiating means.

5. The antenna of claim 4, said radiating means defining a plane of polarization, the opposite peripheral edges of said reflector being folded so as to intersect said plane of polarization.

6. The antenna of claim 4, said reflector and said radiating means being located in respective planes separated by a first distance, the opposite peripheral edges at said reflector are located at a second distance, said second distance being smaller than said first distance.

* * * * *